US005088547A

United States Patent [19]

Schmid

[11] Patent Number: 5,088,547

[45] Date of Patent: Feb. 18, 1992

[54] ELECTROMAGNETIC STIRRER FOR CONTINUOUS CASTING

[75] Inventor: Markus Schmid, Wadenswil, Switzerland

[73] Assignee: Concast Standard AG, Zürich, Switzerland

[21] Appl. No.: 572,861

[22] Filed: Aug. 24, 1990

[30] Foreign Application Priority Data

Aug. 28, 1989 [DE] Fed. Rep. of Germany ..... 3928311

[51] Int. Cl.[5] ..... B22D 27/02

[52] U.S. Cl. ..... 164/504; 164/468

[58] Field of Search ..... 164/466, 467, 468, 502, 164/503, 504, 147.1, 499

[56] References Cited

FOREIGN PATENT DOCUMENTS

| | | | |
|---|---|---|---|
| 0010314 | 4/1980 | European Pat. Off. | 164/504 |
| 0069270 | 1/1983 | European Pat. Off. | 164/504 |
| 2441448 | 6/1980 | France . | |
| 59-21256 | 5/1984 | Japan | 164/504 |
| 63-104764 | 5/1988 | Japan | 164/504 |

*Primary Examiner*—Kuang Y. Lin

*Attorney, Agent, or Firm*—Peter K. Kontler; Tobias Lewenstein

[57] ABSTRACT

An electromagnetic stirrer for stirring the molten core of a continuously cast strand has a casing. The casing accommodates a body of oil as well as electromagnetic stirring coils which have respective magnet cores and are immersed in the oil. A system of cooling pipes extends into the oil and has water inlets and water outlets. The stirrer may be constructed as a unit with a continuous casting mold and, in such an event, the water inlets are connected to a source of mold cooling water while the water outlets function to discharge or recycle the water. Alternatively, the stirrer may be disposed in the secondary cooling zone. Here, the water inlets are connected to a source of secondary cooling water for the strand and the water outlets are in communication with spray nozzles which serve to spray the strand with the secondary cooling water.

18 Claims, 1 Drawing Sheet

ELECTROMAGNETIC STIRRER FOR CONTINUOUS CASTING

BACKGROUND OF THE INVENTION

The invention relates generally to continuous casting.

More particularly, the invention relates to an electromagnetic stirrer for stirring the molten core of a partially solidified, continuously cast strand in a continuous casting apparatus.

Electromagnetic stirrers for continuous casting apparatus are known and generally include a casing which accommodates electromagnetic coils provided with respective cores. Such a stirrer is cooled by a cooling liquid. Electromagnetic stirrers are used both inside and beneath continuous casting molds and the purpose of these stirrers is to improve the quality of a continuously cast strand.

The French Patent Application No. 78 33156 discloses an electromagnetic stirrer which functions to stir the molten core of a partially solidified, continuously cast strand and is disposed inside a continuous casting mold. The stirrer comprises electromagnetic coils provided with respective cores and a magnetic yoke. The coils, cores and yoke are accommodated in a casing having an inlet and an outlet for cooling water. The cooling water, which is used to remove the heat generated by the coils, is the same water as used to cool the mold.

Although the hardness, salt content and pH of the mold cooling water, as well as the amount of suspended matter, are kept within narrow ranges, flow of the cooling water through the electromagnetic stirrer, and the accompanying exposure of the cooling water to magnetic fields, may result in harmful sedimentation and other deposition. This not only requires costly downtime for additional maintenance but can also lead to malfunctions.

Expensive supplemental water treatment is necessary in order to avoid such malfunctions and additional maintenance. Thus, the water must be purified to such a degree that the specific conductivity does not exceed 500 microsiemens per centimeter and the maximum particle size of suspended matter is no greater than 5 microns. Moreover, all ferromagnetic particles must be filtered out and the concentrations of carbon dioxide, ammonia, nitrides, dissolved iron, dissolved manganese, sulfates, chlorides and silicates must be minimized.

The additional maintenance, malfunctions and supplementary water treatment outlined above all reduce the economic benefits and efficiency of electromagnetic stirring during continuous casting.

SUMMARY OF THE INVENTION

It is an object of the invention to provide an electromagnetic stirrer which can operate with greater efficiency.

Another object of the invention is to provide an electromagnetic stirrer which is capable of operating with relatively little maintenance.

A further object of the invention is to provide an electromagnetic stirrer which is less likely to give rise to malfunctions.

An additional object of the invention is to provide an electromagnetic stirrer which can operate effectively without supplementary treatment of the cooling fluid for the coils.

It is also an object of the invention to provide a more efficient method of electromagnetically stirring the molten core of a partially solidified, continuously cast strand in a continuous casting apparatus.

Yet another object of the invention is to provide an electromagnetic stirrer which makes it possible to eliminate expensive checking of the specific electrical conductivity of the coolant for the coils and expensive checking of the amounts of suspended solids, ferromagnetic particles and salts contained in the coolant.

The preceding objects, as well as others which will become apparent as the description proceeds, are achieved by the invention.

One aspect of the invention resides in an electromagnetic stirrer for stirring the molten core of a partially solidified, continuously cast strand in a continuous casting apparatus. The stirrer comprises a casing and a body of fluid confined in the casing, i.e., the stirrer comprises a body of fluid which is stationary in the sense that it is not depleted and replenished during a casting procedure by fluid leaving and entering the body. The stirrer further comprises an electromagnetic coil at least partly immersed in the body and conduit means defining a flow path for a cooling fluid. At least a portion of the conduit means is disposed inside the casing in the region of the body of fluid.

The stirrer may also include a core for the coil. Preferably, the stirrer includes a plurality of electromagnetic coils and a respective core for each coil. In this case, all of the coils and their associated cores are advantageously immersed in the body of fluid.

The stirrer of the invention makes it unnecessary to subject the cooling fluid to the expensive treatment outlined above. Cooling fluid already being employed in the continuous casting plant for other purposes, e.g., water for cooling the mold or water for secondary cooling of the continuously cast strand, can be used to cool the stirrer. If the conduit means of the stirrer has sufficiently large radii of curvature and the flow speed of the cooling fluid in the conduit means is sufficiently high, even a cooling liquid contaminated with suspended solids can be used without damaging or otherwise affecting the stirrer. In this manner, the economics of electromagnetic stirring in continuous casting can be improved.

According to an advantageous embodiment of the invention, the body of fluid is an electrical insulator such as oil while the conduit means is connected to a source of water. However, this combination of cooling liquids can be replaced by combinations of other cooling media known in the art. It is preferred for the cooling fluids used in the stirrer of the invention to be liquids.

The continuous casting apparatus will generally constitute part of a continuous casting plant or facility. Depending upon the position of the stirrer in the continuous casting apparatus, the flowing cooling fluid for the stirrer, i.e., the cooling fluid which flows through the conduit means, can be water which is available in the plant.

The continuous casting apparatus includes a continuous casting mold which may be mounted so that it can be oscillated during a continuous casting procedure. The mold is provided with one or more cooling channels which are supplied with cooling water from a suitable source. According to one embodiment of the invention, the stirrer is arranged to oscillate with the mold, e.g., by designing the mold and stirrer as a unit, and the conduit means is connected to the source of mold cooling water. The source, conduit means and mold cooling channels may then all constitute part of a circulatory system for the mold cooling water. The conduit means may be disposed in series or parallel with the mold cooling channels. If the conduit means is arranged in series with the mold cooling channels, the conduit means is preferably situated downstream of the channels.

The continuous casting apparatus further includes a secondary cooling zone for the strand. The secondary cooling zone may comprise one or more spray nozzles which are directed towards the strand and are connected to a source of secondary cooling water. According to another embodiment of the invention, the stirrer is separate from the mold and is fixed. Here, the continuous casting apparatus and its operation can be simplified by arranging the conduit means between the spray nozzles and the source of secondary cooling water. The conduit means then has inlet means connected to the source and outlet means connected to the spray nozzles.

The conduit means may have various configurations. Moreover, the conduit means may be provided with ribs or may be ribless.

The conduit means may be made of a nonferromagnetic material such as copper or stainless steel. This may be of advantage in that it allows the magnetic field to be at least partly screened by the flowing cooling fluid.

The conduit means can be constituted by a plurality of independent conduits each of which is provided with its own cooling fluid inlet. This enables the conduit means to have a high cooling capacity. The conduit means can here be designed with few detours and large radii of curvature and such that the distances travelled by the flowing cooling fluid are very short. In this manner, the quality requirements imposed on the cooling fluid can be further reduced.

The area of the casing which is exposed to thermal radiation from the strand may be provided with a cooling jacket or radiation shield. This makes it possible to prevent heating of the body of fluid in the casing by thermal radiation from the strand. If the casing is provided with a cooling jacket, the jacket may be connected to a source of cooling water. Advantageously, the jacket is connected to the outlet means of the conduit means.

The novel features which are considered as characteristic of the invention are set forth in particular in the appended claims. The improved electromagnetic stirrer itself, however, both as to its construction and its mode of operation, together with additional features and advantages thereof, will be best understood upon perusal of the following detailed description of certain specific embodiments when read in conjunction with the accompanying drawings.

DESCRIPTION OF THE PREFERRED EMBODIMENTS

Figure 1:
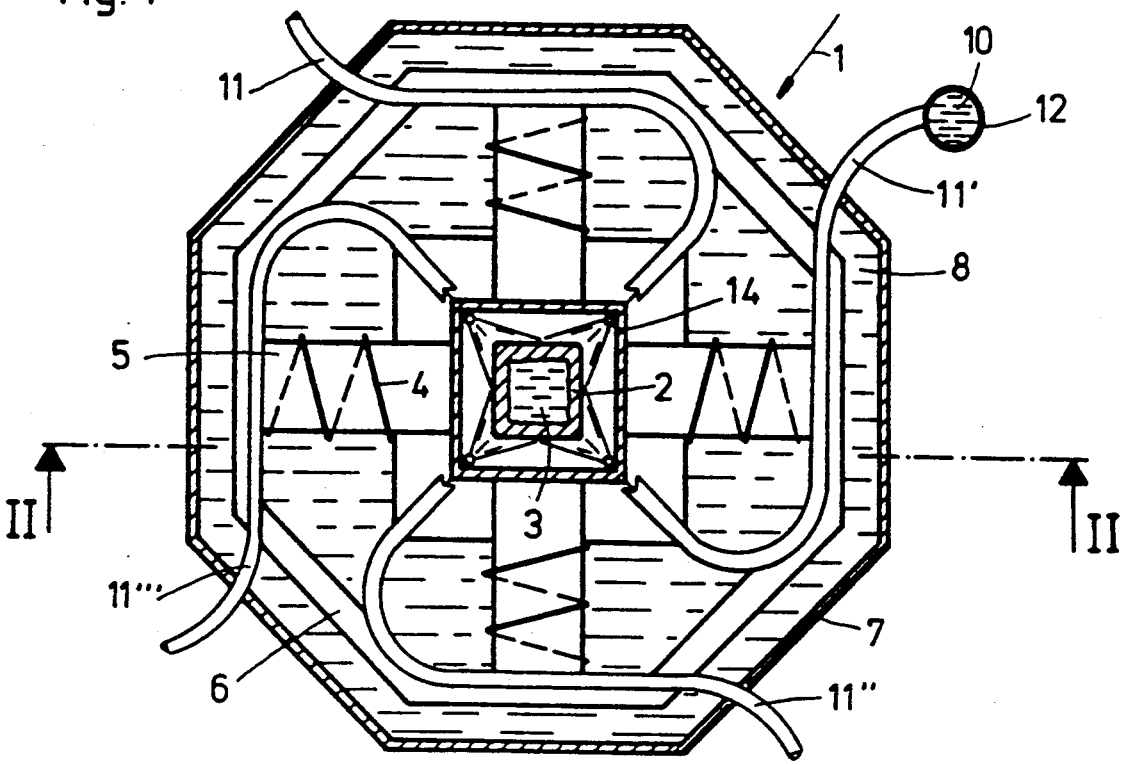
FIG. 1 is a cross-sectional view of one embodiment of a continuous casting apparatus equipped with an electromagnetic stirrer according to the invention.
Figure 2:
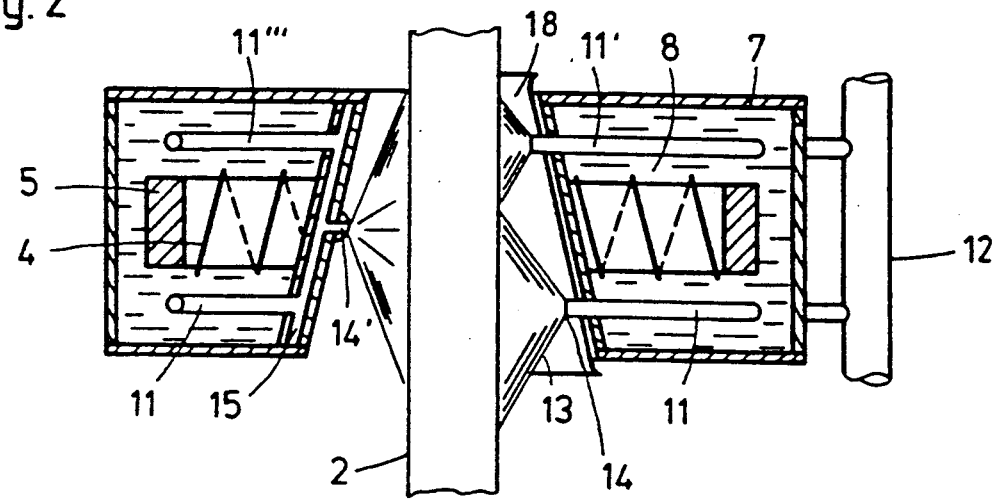
FIG. 2 is a cross-sectional view as seen in the direction of the arrows II—II of FIG. 1.

FIGS. 1 and 2 illustrate a continuous casting apparatus for the production of a continuously cast strand 2. For the sake of clarity, only those parts of the apparatus necessary for an understanding of the invention are shown.

The continuous casting apparatus includes a non-illustrated continuous casting mold which, in the casting direction, is followed by the illustrated secondary cooling zone. The continuous casting apparatus is here assumed to be of the vertical or curved-mold type so that the secondary cooling zone is located below the mold. The strand 2 is only partially solidified in the secondary cooling zone and is constituted by a solidified outer shell or skin and a molten core 3 which is confined by the shell or skin.

An electromagnetic stirrer 1 circumscribes the strand 2 in the secondary cooling zone. The stirrer 1, which functions to stir or agitate the molten core 3 of the strand 2, comprises four electromagnetic stirring coils 4 each of which is provided with a magnet core 5. A magnet yoke 6 connects the magnet cores 5 to one another.

The stirrer 1 further comprises a casing 7 which accommodates a body 8 of cooling liquid. The body 8 is confined by the casing 7 which maintains the body 8 stationary in the sense that the latter remains in the casing 7 during a continuous casting procedure, i.e., the body 8 is not depleted or replenished during operation by liquid leaving or entering the body 8. However, currents may be generated internally of the body 8 during operation due to thermal gradients within the body 8. It is also possible to artificially induce currents in the body 8 if necessary. The stirring coils 4, magnet cores 5 and magnet yoke 6 are all immersed in the body 8.

The body 8 is preferably an electrical insulator and may, for example, be constituted by a cooling liquid such as oil.

As shown on the right-hand side of FIG. 2, the secondary cooling zone of the continuous casting apparatus includes a plurality of spray nozzles 14 which are arranged to direct fan-shaped sprays 13 of secondary cooling water 10 against the strand 2. In addition to cooling the strand 2, the sprays 13 function to at least partly shield the casing 7 against thermal radiation from the strand 2. A feed pipe 12 supplies the secondary cooling water 10 to the spray nozzles 14.

A conduit system or conduit means 11,11',11'',11''' is disposed in the casing 6 and serves to conduct a cooling liquid through the body 8. The conduit system 11–11''' is advantageously made of nonferromagnetic material such as copper, stainless steel or the like. It is preferred that the cooling liquid for the conduit system 11–11''' be a liquid which is used for the continuous casting procedure in the immediate vicinity of the stirrer 1. In the illustrated embodiment, the secondary cooling water 10 for direct cooling of the strand 2 constitutes the cooling liquid for the conduit system 11–11'''. To this end, the conduit system 11–11''' is disposed between the feed pipe 12 and the spray nozzles 14. Thus, the inlet or inlets of the conduit system 11–11''' are connected to the feed pipe 12 while the outlet or outlets of the conduit system 11–11''' are connected to the spray nozzles 14. The secondary cooling water 10 from the feed pipe 12 then first cools the stirrer 1 and thereafter cools the strand 2.

No treatment is required for the liquid used in cooling the stirrer 1.

As best seen in FIG. 2, the conduit means 11–11''' is designed such that a portion thereof is disposed above, and another portion thereof is disposed below, the magnet yoke 6.

In accordance with an advantageous embodiment of the invention, the conduit system 11–11''' is divided into a plurality of separate conduits 11,11',11'',11'''. Each of the conduits 11,11',11'',11''' has its own cooling liquid inlet and its own cooling liquid outlet. By virtue of this design, the conduits 11,11',11'',11''' can be kept short and the number of bends in the conduit system 11–11''' can be reduced to a minimum. The outlet of each conduit 11,11',11'',11''' may, for example, be connected to a discrete spray nozzle 14 for secondary cooling of the strand 2.

The casing 7 has a peripheral surface which faces and surrounds the strand 2 and is thus exposed to thermal radiation from the latter. According to a further embodiment of the invention shown on the left-hand side of FIG. 2, the casing 7 is provided with a cooling jacket 15 adjacent to this peripheral surface. The cooling jacket 15 may be situated between the conduit system 11–11''' and a spray nozzle 14' for secondary cooling of the strand 2. This is illustrated on the left side of FIG. 2. Thus, the cooling jacket 15 has an outlet connected to the spray nozzle 14' and one or more inlets connected to the outlet or outlets of the conduit system 11–11'''. The secondary cooling water 10 in the feed pipe 12 then flows through the conduit system 11–11''' to the water jacket 15 and, from the latter, to the spray nozzle 14' which discharges the secondary cooling water 10 against the strand 2 so as to cool the same. The cooling jacket 15 may be replaced by a radiation shield 18 as shown on the right side of FIG. 2.

The stirrer 1 in FIGS. 1 and 2 is fixedly mounted in the secondary cooling zone.

Figure 3:
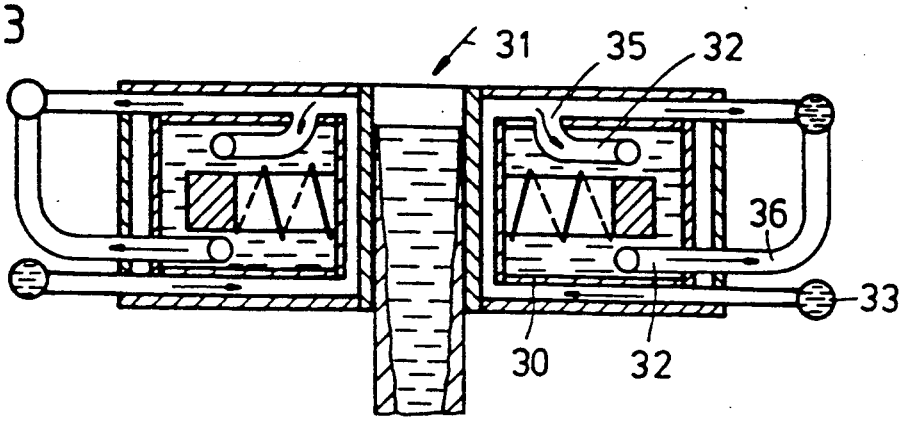
FIG. 3 is a cross-sectional view similar to FIG. 2 through another embodiment of a continuous casting apparatus equipped with an electromagnetic stirrer according to the invention.

FIG. 3 shows a continuous casting mold 31 of another embodiment of a continuous casting apparatus according to the invention. An electromagnetic stirrer substantially identical to that of FIGS. 1 and 2 includes a casing 30 which is fast with the mold 31 and confines a body of cooling liquid. One or more electromagnetic coils with respective cores are immersed in the body of cooling liquid. A conduit system 32 for conducting a cooling liquid through the body extends into the casing 30 and has one or more inlets 35 as well as one or more outlets 36.

The mold 31 is mounted for oscillation in a conventional manner on a non-illustrated oscillator. In contrast to the fixed stirrer of FIGS. 1 and 2, the stirrer of FIG. 3 oscillates with the mold 31.

The mold 31 is formed with one or more cooling channels for cooling the mold 31. One or more feed pipes 33 serve to supply mold cooling water to the cooling channel or channels and each cooling channel has an inlet which is connected to a feed pipe 33. Each cooling channel further has an outlet which is connected to a respective inlet 35 of the conduit system 32. Thus, the mold cooling water supplied by the feed pipe or feed pipes 33 first flows through the cooling channels and then enters the conduit system 32 by means of the inlet or inlets 35. After travelling through the conduit system 32, the mold cooling water is discharged or recycled via the outlet or outlets 36 of the conduit system 32. In this manner, the mold cooling water performs the dual function of cooling the mold 31 and cooling the stirrer.

In the illustrated embodiment, the conduit system 32 is arranged in series with the mold cooling channel or channels and is disposed downstream of such channel or channels. Alternatively, the inlet or inlets 35 of the conduit system 32 can be directly connected to the feed pipe or feed pipes 33 and the conduit system 32 can be arranged in parallel with the mold cooling channel or channels.

As mentioned above, the mold cooling water which leaves the conduit system 32 via the outlet or outlets 36 may be recycled. In such an event, the feed pipe or feed pipes 33, mold cooling channels and conduit system 32 together constitute a circulatory system for the mold cooling water.

Similarly to the embodiment of FIGS. 1 and 2, the cooling liquid for the conduit system 32 of FIG. 3 is constituted by cooling water which is used for the continuous casting procedure in the immediate vicinity of the electromagnetic stirrer. Again, the liquid for cooling the stirrer requires no additional treatment.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An electromagnetic stirrer for stirring the molten core of a partially solidified, continuously cast strand in a continuous casting apparatus, comprising a casing; a body of fluid confined in said casing and being mechanically unagitated from internally thereof; an electromagnetic coil at least partly immersed in said body; and conduit means defining a flow path for a cooling fluid, at least a portion of said conduit means being immersed in said body.

2. The stirrer of claim 1, further comprising a core for said coil.

3. The stirrer of claim 1, wherein said body is an electrical insulator.

4. The stirrer of claim 3, wherein said body comprises oil.

5. The stirrer of claim 1, wherein said conduit means is connected to a source of water.

6. The stirrer of claim 1, further comprising a continuous casting mold fast with said casing, said mold being provided with cooling channel means connected to a source of mold cooling fluid, and said conduit means being in communication with said source, said conduit means, channel means and source all constituting part of a circulatory system for cooling fluid.

7. The stirrer of claim 6, wherein said conduit means is arranged in series with said channel means.

8. The stirrer of claim 7, wherein said conduit means is disposed downstream of said channel means.

9. The stirrer of claim 6, wherein said conduit means is arranged in parallel with said channel means.

10. The stirrer of claim 1, wherein said conduit means has an inlet connected to a source of strand cooling fluid and an outlet connected to a spray nozzle for secondary strand cooling.

11. The stirrer of claim 1, wherein said conduit means comprises a plurality of conduits each having an inlet connected to a source of cooling fluid.

12. The stirrer of claim 1, wherein said casing has a surface designed to be expose-d to thermal radiation from a strand and said casing is provided with a cooling jacket in the region of said surface.

13. The stirrer of claim 12, wherein said conduit means has an outlet and said cooling jacket is connected to said outlet.

14. The stirrer of claim 1, wherein said casing has a surface designed to be exposed to thermal radiation from a strand and said casing is provided with a radiation shield devoid of cooling passages in the region of said surface.

15. The stirrer of claim 1, wherein said conduit means is connected to a source of secondary cooling fluid for the continuous casting apparatus.

16. The stirrer of claim 1, wherein said conduit means is connected to a source of secondary cooling fluid for the continuous casting apparatus.

17. An electromagnetic stirrer for stirring the molten core of a partially solidified, continuously cast strand in a continuous casting apparatus, comprising a casing; a body of fluid confined in said casing and being mechanically unagitated from internally thereof, said body being an electrical insulator; an electromagnetic coil at least partly immersed in said body; a core for said coil; and conduit means defining a flow path for a cooling fluid, at least a portion of said conduit means being immersed in said body.

18. An electromagnetic stirrer for stirring the molten core of a partially solidified, continuously cast strand in a continuous casting apparatus, comprising a casing which has a surface designed to be exposed to thermal radiation from a strand, said casing being provided with a radiation shield devoid of cooling passages in the region of said surface; a body of fluid confined in said casing and being mechanically unagitated from internally thereof, said body being an electrical insulator; an electromagnetic coil at least partly immersed in said body; a core for said coil; and conduit means defining a flow path for a cooling fluid, at least a portion of said conduit means being immersed in said body.

* * * * *